US012617573B2

(12) United States Patent
Hartmann et al.

(10) Patent No.: US 12,617,573 B2
(45) Date of Patent: May 5, 2026

(54) METHOD FOR AUTOMATICALLY MAINTAINING A PREDETERMINED PORTION ARRANGEMENT IN A TRAY TROUGH AND PACKAGING APPARATUS SUITABLE THEREFOR

(71) Applicant: MULTIVAC SEPP HAGGENMÜLLER SE & CO. KG, Wolfertschwenden (DE)

(72) Inventors: Albert Hartmann, Dietmannsried (DE); Bernhard Klaus, Dietmannsried (DE)

(73) Assignee: Multivac Sepp Haggenmüller Se & Co. KG, Wolfertschwenden (DE)

( * ) Notice: Subject to any disclaimer, the term of this patent is extended or adjusted under 35 U.S.C. 154(b) by 0 days.

(21) Appl. No.: 18/765,309

(22) Filed: Jul. 7, 2024

(65) Prior Publication Data

US 2025/0011025 A1 Jan. 9, 2025

(30) Foreign Application Priority Data

Jul. 7, 2023 (DE) ..... 102023117964.0

(51) Int. Cl.
*B65B 25/06* (2006.01)
*B65B 57/14* (2006.01)

(52) U.S. Cl.
CPC ..... *B65B 57/14* (2013.01); *B65B 25/06* (2013.01)

(58) Field of Classification Search
None
See application file for complete search history.

(56) References Cited

U.S. PATENT DOCUMENTS

2018/0345520 A1* 12/2018 Eckhardt ..... B26D 5/00

FOREIGN PATENT DOCUMENTS

DE 102019101852 A1 7/2020
DE 102021127095 A1 4/2023

OTHER PUBLICATIONS

German Search Report, DE Application No. 102023117964.0, Applicant: Multivac Sepp Haggenmuller Se & Co. KG, dated May 15, 2024 (with English machine translation) (15 pages).

* cited by examiner

*Primary Examiner* — Chinyere J Rushing-Tucker
(74) *Attorney, Agent, or Firm* — Brooks Kushman P.C.

(57) ABSTRACT

In order to ensure that portions are visually appealing, i.e., centered,
have uniform slice spacing in a longitudinal direction and do not differ too much in a transverse direction, and
in particular do not rest on a sealing edge of a trough belt in its trough, the corresponding portion arrangement on a packaging element is, as is known, determined directly in a packaging machine from above by means of a camera and if a deviation from a target arrangement is too great, production parameters in upstream units of the packaging machine are adjusted, i.e., across a gap between a portioning belt and the packaging machine. According to the disclosure, the actual arrangement of the portion is determined from below the packaging element, in particular the trough, and through said the packaging element by means of radar radiation.

19 Claims, 9 Drawing Sheets

METHOD FOR AUTOMATICALLY MAINTAINING A PREDETERMINED PORTION ARRANGEMENT IN A TRAY TROUGH AND PACKAGING APPARATUS SUITABLE THEREFOR

CROSS-REFERENCE TO RELATED APPLICATIONS

This application claims foreign priority benefits under 35 U.S.C. § 119 (a)-(d) to German patent application number DE 102023117964.0 filed, Jul. 7, 2023, which is incorporated by reference in its entirety.

TECHNICAL FIELD

The disclosure relates to the arrangement of a portion consisting of a plurality of slices, in particular shingled slices, on a packaging element, in particular in a trough of a deep-drawn trough belt.

BACKGROUND

The portion placed on such a packaging element, in particular in the trough, should have the correct size and shape and be placed in the trough in the correct position, for example, so that a visually appealing appearance is achieved, for example lying centrally in the trough, and above all not lying on the sealing edge surrounding the trough, as this prevents the sealing film that tightly seals the trough from being sealed.

The portions to be packaged in the packaging machine, i.e., to be deposited and sealed, are usually cut upstream of the machine by means of a high-performance slicing machine, referred to as a slicer, from rod-shaped product strands, referred to as logs, usually in multiple tracks next to each other by the same blade, for example a rotating sickle blade.

Each separated slice falls onto a discharge unit, which usually consists of three conveyor belts arranged one behind the other in the conveying direction, of which in particular the first, referred to as the portioning belt, is usually adjustable in many ways and, above all, can be driven in a stepwise manner, and on which the slices of a track land one after the other at a certain distance, so that, for example, a shingled portion is created.

From this discharge unit, which can be an independent unit, but is usually part of the slicer, because in order to produce correct positions, the discharge unit, in particular the portioning belt, must be controlled in exact temporal and spatial coordination with the movement of the blade, the portions transported away from the slicer in multiple tracks are usually not fed or inserted directly into the packaging machine, but there is an insertion belt in between, usually a conveyor belt that runs across the width of all the tracks.

This inserter, as it is called, is usually inclined downward in the conveying direction and deposits the transported portions, usually in formats that cover more than one portion track, into the troughs formed in a plurality of rows next to each other in a trough belt according to the number of tracks, which trough belt passes under the inserter.

Due to a variety of influencing factors, such as

- the centrifugal force generated by the rapidly rotating blade,
- the adhesion of the slices to the blade,
- the non-constant accelerations of all tracks of the discharge unit in the case of track-specific discharge units,

- the different weight and cross section of the logs when different types of logs are sliced on the different tracks for mixed portions,
- the portions already on the portioning belt are not in the desired, predetermined shape or size or relative position of the portions with respect to each other.

For example, the portion may be too long or too short, the longitudinal spacing of the slices within the portion may be uneven, or the slices may not be in exactly one row in the longitudinal direction, but may be offset too far from each other laterally. Attempts have already been made to correct this in part within the discharge unit or on the portioning belt, or only on the inserter.

It is known, for example, to use a camera aimed at the portions or formats from above to record the position of the portions and their individual slices, either on the portioning belt, sometimes while the portion is still being produced, or only on the inserter or packaging element, and to improve the design of the portion at least for subsequent portions by adjusting the production parameters, for example by transverse displacement of the individual tracks or the entire portioning belt between the landing of two successive slices.

However, a camera positioned in this way does not always have a clear field of view, for example because an operator moves into the field of view over the portions.

However, even if the portion produced on the portioning belt corresponds to the target specifications there, the subsequent movements of the portion up to the packaging element, for example the transfers between individual conveyors, in particular to the downwardly inclined inserter, and possibly further transfers between the discharge unit of the slicer and the buffer arranged on the inserter, can lead to further undesirable changes in the shape and position of the portions, which is why determining the actual arrangement of the portion only on or in the packaging element is the preferred solution.

SUMMARY

It is therefore an object of the disclosure to provide a method with which portions having a predetermined arrangement, in particular with regard to shape, size and storage position on a packaging element, in particular in the trough of a trough belt or an already separated trough, can be reliably produced, and to provide a packaging apparatus suitable for this purpose consisting of a packaging machine on the one hand and a packaging delivery unit, a portion delivery unit and a portion production unit on the other hand.

This object is achieved by the features of claims 1 and 8. Advantageous embodiments result from the subclaims.

First of all, it should be clarified that a portion arrangement of the portion on or in a packaging element does not only mean the overall portion position relative to the packaging element or absolutely to the base frame of the machine, but also the arrangement within the portion, for example the length measured in the transport direction or the width of the portion measured horizontally transversely thereto or the height of the portion, the latter in particular in the case of folded slices within the portion, or also the shape of the portion, for example the relative position of the individual slices with respect to one another with respect to an offset in the longitudinal or transverse direction.

The target arrangement describes the ideal state for each of these arrangement parameters in the form of a target arrangement value and an associated tolerance range, which can extend to one side or both sides of the target value of the target arrangement and is the range within which the actual arrangement of the portion is still accepted as tolerable and, in particular, no change occurs in a production parameter that influences this measured value.

Furthermore, it should be clarified that the production parameters are understood to be the control parameters of the units of the machine located upstream of the insertion point in or on the packaging element, which have an influence on the portion arrangement, for example

- blade speed,
- cutting gap,
- speed of the portioning belt or one of the other belts,
- in a clocked operation, the downtime between the individual step movements,
- the speed-time diagram of these movements,
- the absolute position of one of the belts in the longitudinal or transverse direction at a reference time or at a reference state.

With regard to the method for automatically achieving a predetermined portion arrangement of a portion deposited on a packaging element, for example in a packaging trough of a trough belt, in particular a shingled portion made up of a plurality of slices, it is known that

- first, the actual state of the portion arrangement, i.e., the actual arrangement, is automatically determined in the deposited state of the portion,
- this actual arrangement is automatically compared to the specified target arrangement, i.e., the target arrangement values specified in the target arrangement, in terms of its relevant arrangement values,
- if the actual arrangement deviates from the target arrangement for at least one arrangement value by more than the tolerance value additionally specified for this target arrangement value, i.e., an actual arrangement outside the tolerance range of the target arrangement,
- at least one of the production parameters of the upstream units is automatically changed so that the portion produced with this changed production parameter and placed on the packaging element has an actual arrangement that does not deviate from the target arrangement by more than the specified tolerance values, i.e., is within the tolerance range around the target arrangement value.

This makes it possible to achieve the desired target arrangement of one of the subsequent portions relative to the packaging element when it is stored, because all potentially negative factors influencing the portion arrangement are between the place and time of creation of the portion and the state in which the actual arrangement is determined.

According to the disclosure, the actual arrangement of the portion is determined without contact from below the packaging element in order to avoid any mechanical influence on the portion.

This also makes it possible to determine the amount of food while, for example, an operator is bending over the packaging element containing the portion to inspect it from the operator side and would thus be in the beam path of a camera arranged centrally above the packaging element, in particular the filled trough.

Preferably, the actual arrangement is determined by emitting electromagnetic radiation onto or through the portion, which electromagnetic radiation is emitted by a transmitter, in that electromagnetic radiation reflected from the portion and/or the packaging element is received by a corresponding receiver and the actual arrangement of the portion can be determined therefrom by means of signal evaluation.

This results in a structurally very simple sensor apparatus.

Preferably, the actual arrangement is determined by means of electromagnetic radiation with a wavelength outside the range visible to the human eye.

This makes it possible to select a wavelength that is best suited to the desired purpose and beam path, as well as a desired penetration depth into the portion and/or the trough belt.

For example, the wavelength and power of the electromagnetic radiation can be selected so that the actual arrangement of the portion can be determined through the packaging element, i.e., in particular by transirradiating the packaging element with the electromagnetic radiation.

This means that there is no need to worry about interference with the measurement that occurs above the portion, and the transmitter and/or receiver of the electromagnetic radiation can be positioned in a well-protected manner below the packaging element.

An alternative is to determine the actual arrangement by emitting the electromagnetic radiation onto the portion from just above the portion, wherein the transmitter and/or receiver are preferably arranged in a vertical position below the packaging element.

Just above means that this height difference is less than the usual height difference of interference that can occur above the deposited portion, for example an operator leaning over the deposited portion.

Just above means in particular that the last deflection for the radiation installed in the beam path of this electromagnetic radiation before the portion is arranged at most 30 cm, in particular at most 20 cm, in particular at most 10 cm above the top of the deposited portion.

Such scanning is therefore possible in particular by deflecting the electromagnetic radiation from a radiation source arranged below the packaging element by means of at least one deflection element arranged laterally just above the portion, in particular the packaging element, onto the upper side of the portion.

In this way, the transmitter can still be well protected from the electromagnetic radiation.

Preferably, the electromagnetic radiation used is one having a wavelength between 20 GHz and 6 THz, in particular one having a wavelength between 0.3 THz and 6 THz or in the radar range between 20 GHz and 40 GHz.

In particular when irradiating from below, the power used is such that at least the packaging element is completely transirradiated.

In this way, the peripheral contour of the packaging element, in particular the edge of a packaging trough, is determined and the portion lying thereon is determined in its actual arrangement relative to the packaging element and/or the absolute position relative to the base frame of the machine.

Preferably, in addition to the packaging element, the portion lying thereon is at least partially, in particular completely, transirradiated.

Deviations between the target arrangement and the actual arrangement can also be caused by random and one-time or rare factors, such as insufficient static friction on only one or a few of the packaging elements.

It is not the aim of the present application to eliminate such random, one-time or rare deviations of the actual arrangement from the target arrangement of the portion, especially since this is usually not possible since the reason for this is often not known and cannot be determined. Instead, system errors that cause a recurring deviation of the actual arrangement from the target arrangement should be eliminated.

Therefore, the production parameters are only changed if the detected deviation has been determined to be a recurring error, even if the actual arrangement is outside the tolerance ranges of the at least one tolerance range of the target arrangement.

This means, for example, that the detected deviation was detected at least 3 times, in particular at least 5 times, in particular at least 7 times in immediate succession, i.e., without a correct actual arrangement in between, or at least 6 times, preferably at least 8 times within 10 consecutive determination processes.

The actual arrangement is usually determined when the packaging element is stationary and preferably as soon as possible after the portion has been placed on or in the packaging element.

This means as soon as possible after the packaging element has come to a standstill, because the depositing, i.e., ejection onto the packaging element from the last conveyor of the portion delivery unit, usually takes place while the packaging element is moving in the transport direction so that the difference in speed between the ejected portion and that of the packaging element on which it lands is as small as possible at the time of landing, preferably zero, and so that the portion does not slip on the packaging element when it lands.

The production parameters of the portions in the slicing machine to be controlled automatically can include

- controlling the speed of the portioning belt running continuously or stepwise as well as its standstill intervals and/or
- controlling the step length of the portioning belt running stepwise and/or
- controlling the time interval between the individual separation processes.

Preferably, a scanner having at least one transmitter and slash or at least one receiver can be used as a sensor, in particular as a radar sensor.

Preferably, the scanning direction of the scanner is arranged transversely to the direction of travel through the machine as well as in the first transverse direction, the width direction of the machine. The scanning direction preferably extends over the entire width of the machine.

Preferably, the radiation is emitted by the individual transmitters in the form of a three-dimensional radiation cone, so that the scanning region of the scanner covers at least one transverse row of troughs, possibly a plurality of transverse rows of troughs following one another in the direction of travel.

Regarding a packaging apparatus comprising

- a packaging machine having a tray sealer for packaging a portion of slices placed on a packaging element, in particular in a packaging trough, in particular in a shingled form, and in particular with a deep-drawing station for producing the troughs in a trough belt
- a portion delivery unit that delivers the portions to the packaging machine, and
- a portion production unit that produces the portions, in particular a slicer having a cutting unit and a portioning belt that can be driven in a controlled manner in relation thereto, and
- a packaging delivery unit that delivers the packaging elements to the packaging machine,
- a sensor for determining by means of electromagnetic radiation the actual arrangement of the portion after it has been deposited relative to the packaging element on which it lies, in particular the packaging trough, or absolutely with respect to the base frame of the machine,
- a controller that is connected to the sensor via data technology and that is able to control production parameters of the upstream portion production unit and/or portion delivery unit and/or the packaging delivery unit depending on the data supplied by the sensor.

In particular, the controller is designed in such a way that it is able to carry out the method described above.

The object is achieved in that the sensor is not arranged above the movement path of the packaging elements, but in a vertical position below the packaging element, in particular laterally next to the movement path of the packaging elements below the packaging element, in particular the trough belt.

This makes it possible to determine the actual portion arrangement of the portion on or in the packaging element without having to arrange a sensor above the movement path of the packaging elements when viewed from above, in the beam path of which interference could occur, for example from the operator.

Preferably, the sensor comprises a transmitter and a receiver for the electromagnetic radiation, in particular of a defined wavelength, which can be functionally combined in the sensor.

However, transmitters and receivers can also be present as separate components, in particular in a scanner that comprises at least one transmitter and at least one receiver, preferably a plurality of at least one of these two types.

Preferably, the sensor operates in the wavelength range between 20 GHz and 6 THz, preferably with radar radiation having a wavelength between 20 gigahertz and 40 gigahertz, as this has proven to be optimal for the transirradiation of food.

Depending on the arrangement of the transmitter, a radar shield that is impermeable to radar radiation may be present on the side of the portion whose arrangement is to be determined and into which no reflected radiation is to be emitted.

Even if the sensor is designed as a scanner, it is preferably designed so that the sensor operates in the range of microwave radiation, in particular with radar radiation, in particular with a frequency of 20 GHz to 40 GHz, or alternatively in the range of tera radiation with a frequency of 0.3 to 6.0 THz, which has also proven to be well suited for transirradiating food.

The sensor or the scanner is designed in such a way that it can operate with a power such that the electromagnetic radiation can determine at least the peripheral contour of the portion, in particular the peripheral contour of all the slices of the portion, and preferably to penetrate into the portion for this purpose, in particular to penetrate therethrough.

Preferably, the scanning direction of the scanner is arranged transversely to the direction of travel through the machine, and the transmitters and receivers are arranged one after the other in the transverse direction of the machine.

Preferably, the scanner extends across the entire width of the machine.

The individual transmitters preferably emit their radiation in the form of a three-dimensional radiation cone, the scanning regions of which preferably overlap one another at the level of the portions, in particular extending across the entire width of all tracks in total.

This allows redundant scanning to take place.

The positions of the sensor or scanner, and in particular its transmitter and receiver, within the machine are preferably known in order to be able to determine the actual portion arrangements from the received signals.

Preferably, the emission direction and/or the reception direction of the at least one transmitter and/or at least one receiver should be known in order to be able to correctly determine the portion arrangement.

If there is a plurality of transmitters and/or receivers, such as those in the form of scanners, they should preferably be equidistant from the support surface of the portion in the packaging element, which facilitates signal evaluation.

Preferably, the transmitters and/or receivers are arranged one behind the other along a scan line extending in the transverse direction of the machine, in particular also within a scanner.

Preferably, when scanners are used in the transverse direction, a plurality of scanners are provided one behind the other, wherein preferably one scanner is designed and positioned such that it can scan the portion arrangement across the width of a track.

DETAILED DESCRIPTION

Figure 1A:
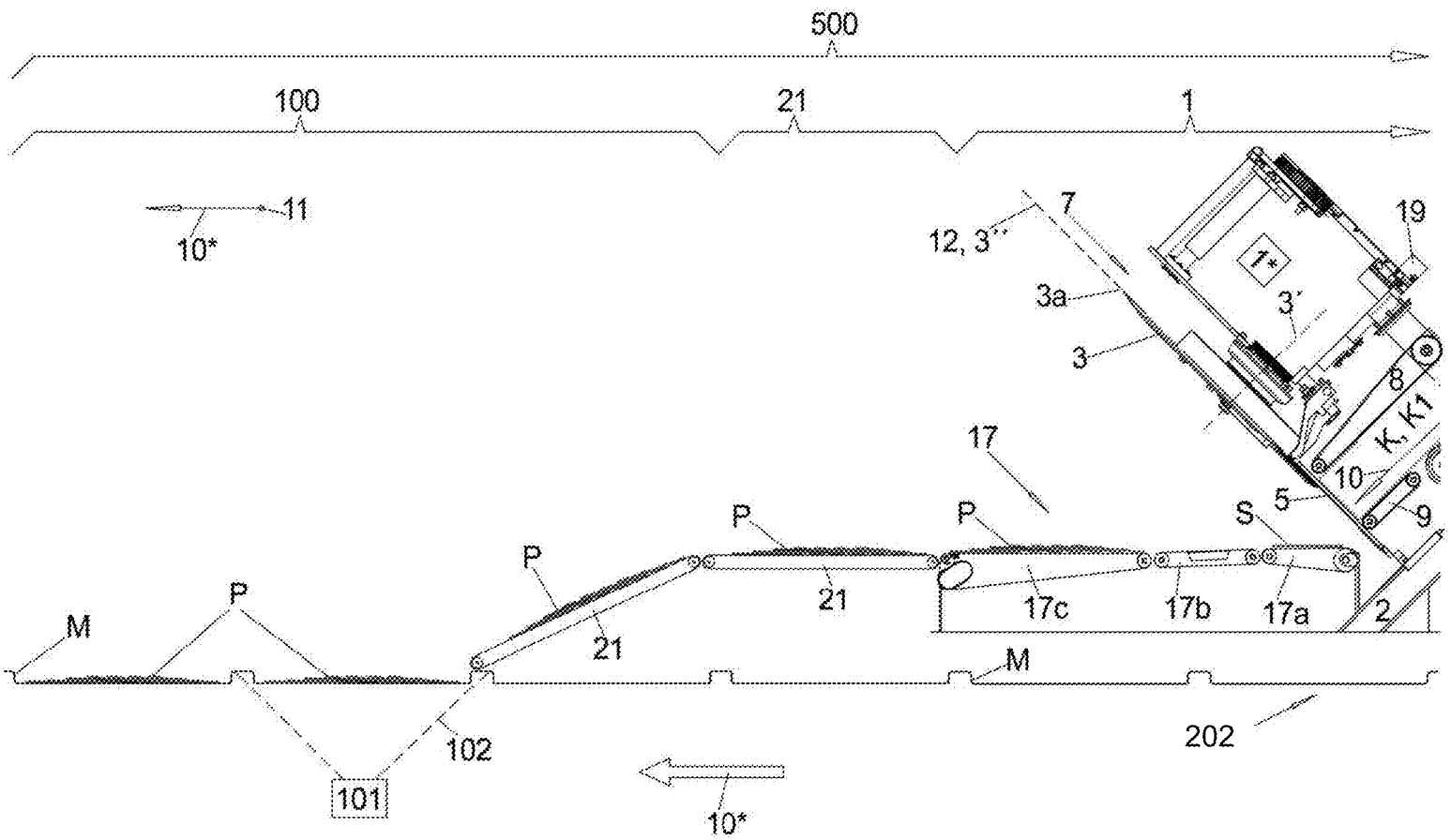
FIG. 1A shows a packaging apparatus consisting of a slicer and a packaging machine arranged downstream in the longitudinal direction, the direction of travel through the apparatus, having an inserter, seen in a side view, in the width direction of the packaging apparatus.

FIG. 1A is a side view of a packaging apparatus 500 having, in the direction of travel 10* through the entire unit, a portion production unit 13, in particular a slicer 1, an inserter 21 as a portion delivery unit 14, a packaging machine 100 and a packaging delivery unit 15 to the insertion point.

The cutting unit 7 of the slicer 1 is visible, which slicer is only partially shown, and the upper product guide 8 and lower product guide 9 of the infeed for the product strands or logs K is shown, between which upper product guide and lower product guide the logs K are held and fed to the cutting unit 7 in a feed direction 10 that is at an angle to the horizontal direction of travel 10* through the entire apparatus.

The blade 3, whose sharply ground cutting edge 3*a* defines the cutting plane 3", is located at a very short distance parallel to the underside of the plate-shaped cutting frame 5, in which underside there is a product opening (not visible here) for each of the plurality of logs K1, K2, . . . , which are usually located one behind the other in the viewing direction in FIG. 1A and are sliced at the same time, through which product opening the logs K fit very precisely so that the peripheral edge of the cutting frames 5 and their product openings form the fixed counter-blade to the cutting edge 3*a* of the blade 3.

Not only are the cutting unit 7 and the infeed for the logs K attached to the base frame 2 of the slicer 1, but a discharge unit 17 is typically also attached thereto, which discharge unit consists of three discharge conveyors 17*a, b, c* arranged one behind the other in the direction of travel 10*, the first of which, the portioning belt 17*a*, can be pivoted in many ways in its inclined position about a pivot axis that aligns with the viewing direction in FIG. 1A so that it is possible to control the impact angle, trajectory and distance at which the slices S cut from the log K land on the portioning belt 17*a*. Because the portioning belt 17*a* can be driven so as to be controlled in a stepwise manner, shingled portions P can be produced thereon, for example.

A trough belt 202 is fed in at a vertical position below the slicer 1, as well as from right to left in the direction of travel 10*, which trough belt is generally intended to deposit a portion P on the bottom of each of its troughs M as a support surface 4.

In order to compensate for the height offset between the trough belt 202 and the discharge unit 17, which is generally located horizontally higher, a so-called inserter 21 is connected to the last discharge conveyor 17*c* of the discharge unit 17. This also involves at least one conveyor belt that runs in the direction of travel 10*, the last of which, however, is directed diagonally downward and ends just above the trough belt 202.

To deposit a portion P, the inserter 21 and the trough belt 202 are driven at the same speed to avoid folding the portions P in the trough M as they are deposited, or more accurately, ejected. The trough belt 202 and/or the inserter 21 can be stopped between the insertion of the individual portions P.

According to the disclosure, according to FIG. 1A and the enlargement according to FIG. 1B, a sensor 101, which in this case is fastened below the trough belt 202, is directed toward the region downstream, in particular immediately downstream, of the inserter 21, with the aid of which the actual arrangement of the portions P in the troughs M can be determined, both quantitatively and qualitatively, i.e., directly in the packaging machine 100.

Figure 2C:
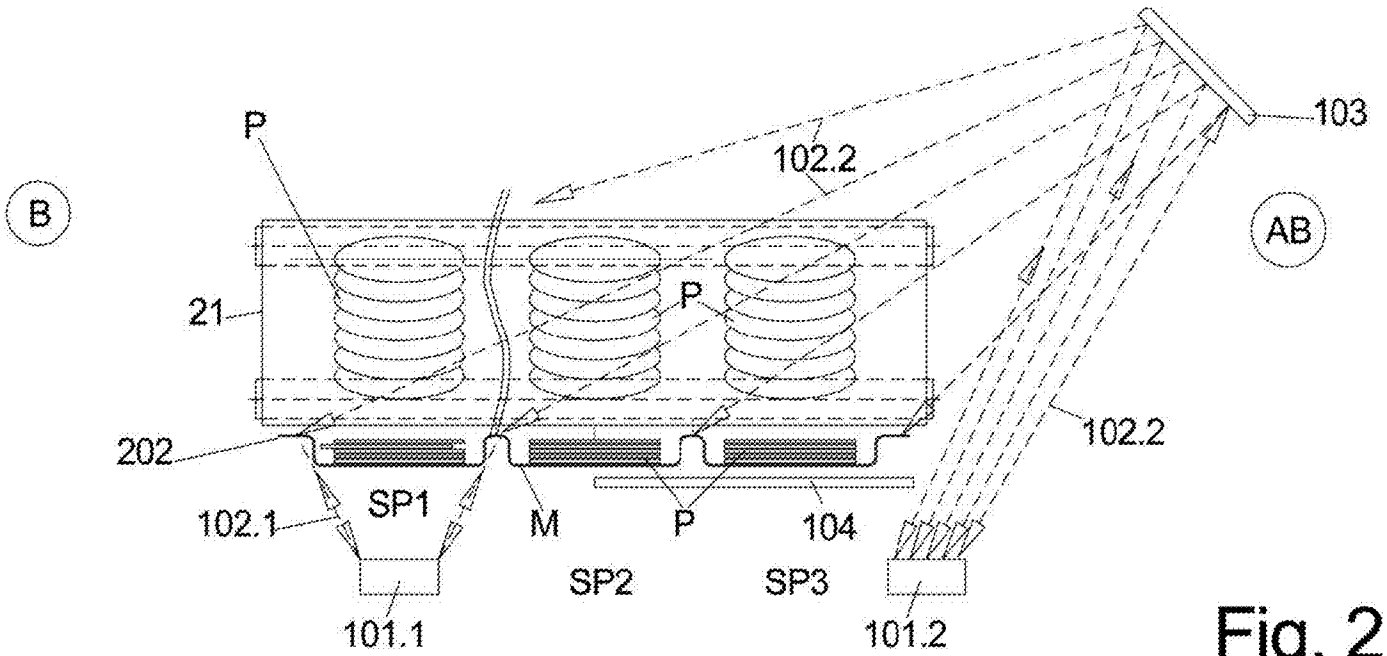
FIG. 2C shows a vertical cross section through an already filled multi-track trough belt, sectioned along the line IIC-IIC in FIG. 2A, with scanning by individual sensors from below.
Figure 2A:
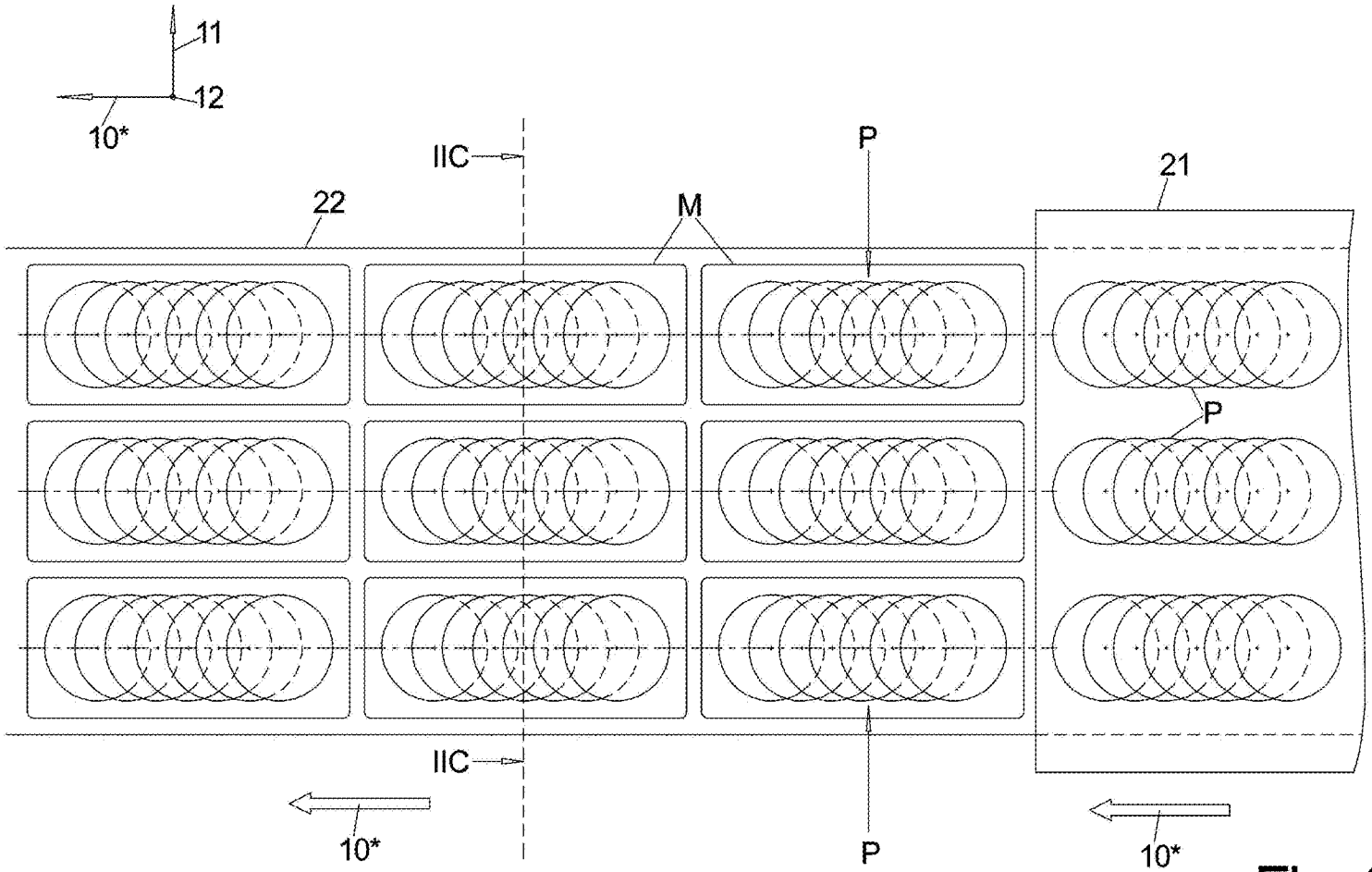
FIG. 2A is a view from above of the region of the inserter and the downstream part of the trough belt with the portions already inserted into the troughs in this part of the trough belt.

FIG. 2A shows the situation in a top view with the front end region of the inserter 21 and the trough belt 202 extending underneath, in the visible troughs M of which trough belt a portion P has already been deposited in each trough M.

Figure 1B:
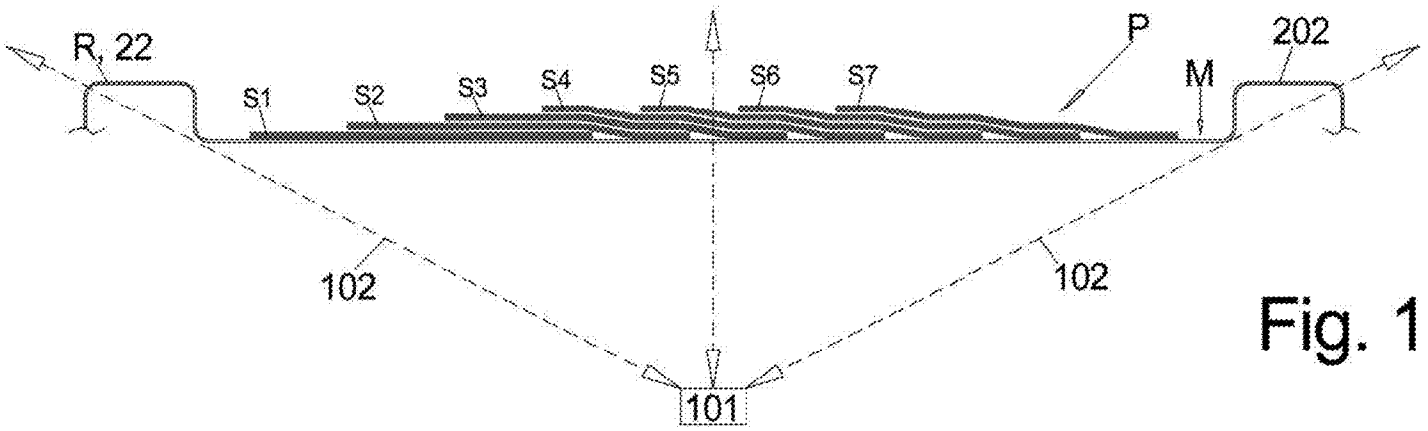
FIGS. 1B, 2B show a single filled trough M in a side view and top view as enlargements of FIGS. 1A and 2A, respectively, wherein the slices of the portion are in the ideal position in the trough, i.e., in the target arrangement.
Figure 2B:
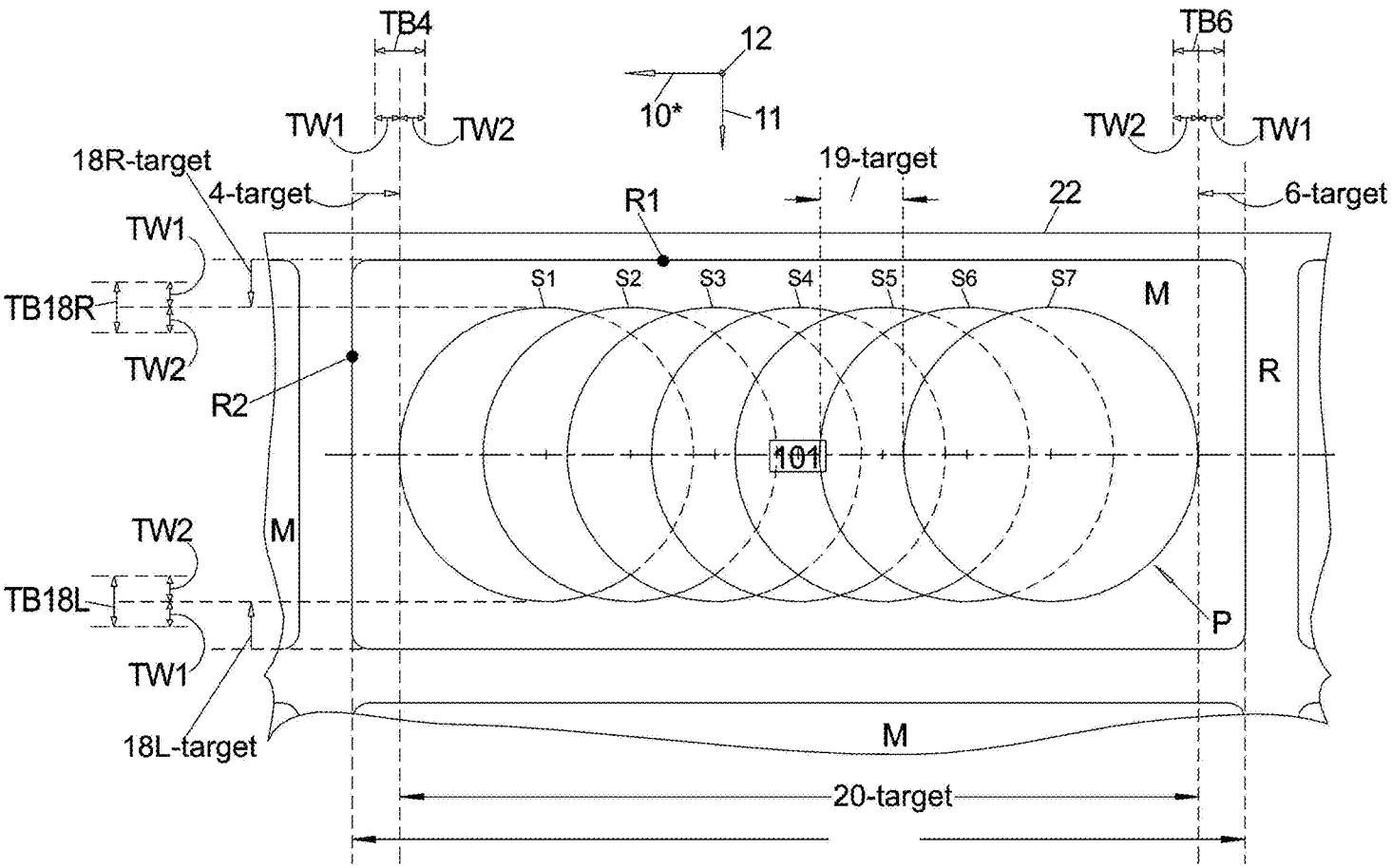

FIGS. 1B and 2B show the situation in side view and top view for only a single trough M with a single portion P lying therein, consisting in this case of seven slices S1 to S7.

FIG. 2B is a top view of the target arrangement of the deposited portion P in the trough M, with corresponding target arrangement values stored in the controller 1*, shown for example in FIG. 1A. In detail:

In the transverse direction 11, the portion P should be located centrally with respect to the edges R on both sides of the trough M with a left target transverse distance 18L-target and a right target transverse distance 18R-target as viewed in the direction of travel 10*, in each case measured from the lateral edge of the trough to the portion P. In this case, each of these two target arrangement values lies in a tolerance range TB, for example TB18L or TB18R, which extends from the target value toward the center of the trough by a tolerance value TW2 and toward the lateral edge of the trough by a tolerance value TW1.

In the longitudinal direction 10, the portion P should be located centrally with respect to the front and rear edge R of the trough M with a front target initial distance 4-target in the direction of flow 10* and a rear target final distance 6-target, in each case measured in the longitudinal direction 10 from the front or rear trough edge to the portion P. In this case, each of these two target arrangement values lies in a tolerance range TB, for example TB4 or TB6, which extends from the target value toward the center of the trough by a tolerance value TW2 and toward the lateral edge of the trough by a tolerance value TW1.

Also within the portion P with the same target slice distances 19-target between any two consecutive slices S of the portion P, wherein a tolerance range (not shown) is also stored in the controller 1* for the target slice distance 19-target, which tolerance range is in turn made up of a negative tolerance value and a positive tolerance value.

For a correct target arrangement of the portion P in the trough M, it is of course also a prerequisite that the trough M is in the correct position at the ejection point and at the time of ejection at which it moves forward, and also at the time at which the arrangement is subsequently recorded by means of the sensor 101 when the trough belt 202 is stopped.

At this time of determination, the trough M of the trough belt 202 should be in a position such that the right edge R of the trough M runs above or below a machine-fixed reference point R1 in the transverse direction 11 and the front edge R runs above or below a machine-fixed reference point R2 in the direction of travel 10*. The reference point R1 is located in the middle of a tolerance range (not shown) that extends in the transverse direction, and the reference point R2 is located in the middle of a tolerance range that extends in the direction of travel 10*.

The following figures show actual arrangements that deviate from the target arrangement of the portion P:

FIG. 3A, B show, again in a side view and top view, an actual arrangement of a portion P that has the most disadvantageous arrangement error, namely with the front end of the first slice S1 resting on the front edge R of the trough M. This prevents a tight seal of this trough by applying a sealing film also on this front edge R and the portion is rejected.

With the aid of a sensor 101, in particular a radar sensor 101, the initial distance 4-actual in the longitudinal direction 10 can be determined as well as the final distance 6-actual with respect to the respective front and rear edge R of the trough M.

Figure 3B:
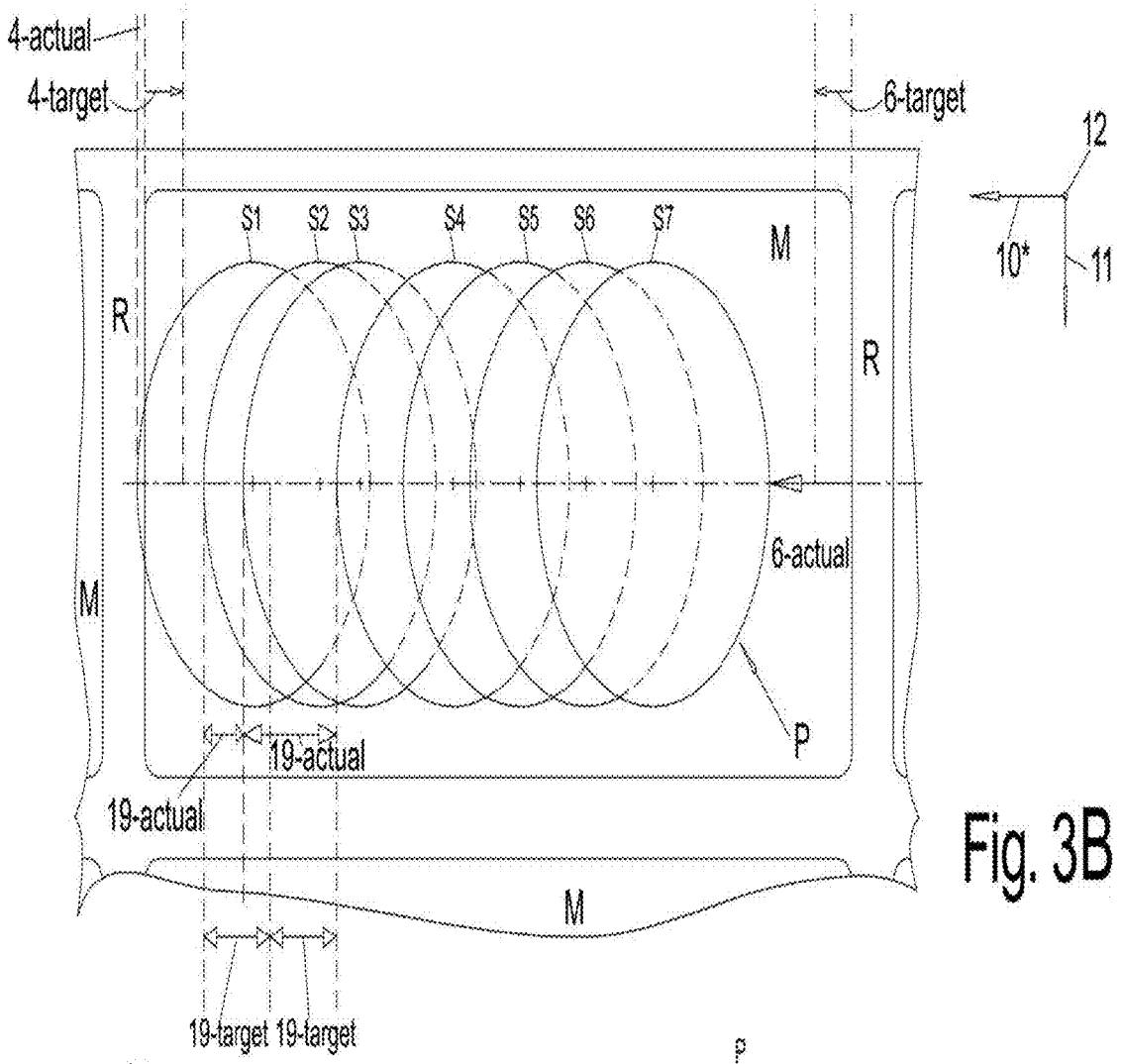
FIGS. 3A, B show the same views as in FIG. 2A, B, but with the portion too far forward in the trough and partially resting on the edge of the trough.
Figure 3A:
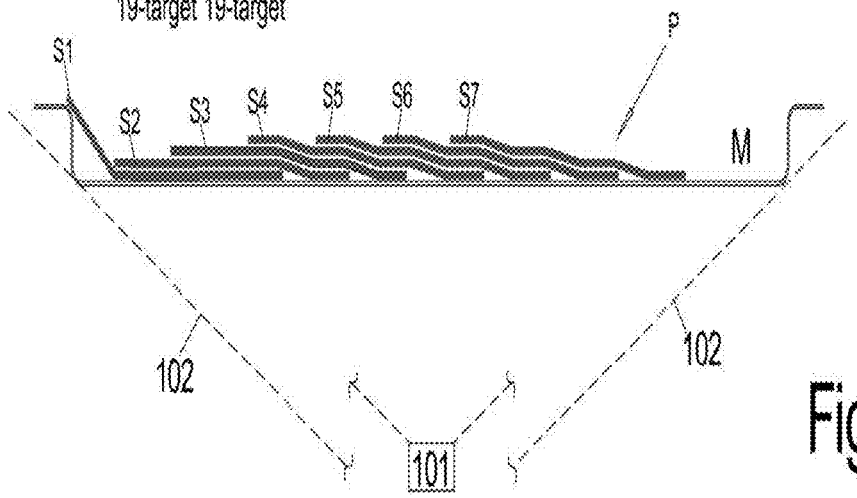

The initial distance 4 and the final distance 6 are measured from the edge of the trough M toward the center of the trough M, so they must be a positive value if positioned correctly. In the case of FIG. 3A, B, the actual initial distance 4-actual is even a negative value, and the actual final distances 4-actual and 6-actual are both outside the tolerance range TB4, TB6 of the distances 4, 6 shown in FIG. 2B.

The production parameters for the portion arrangement must therefore be changed automatically and in a controlled manner so that the front and rear ends of the portion P are within the tolerance range TB4 or TB6 of the initial distance 4-target and the target final distance 6-target.

The actual portion length 20-actual can also be calculated automatically from the determined position of the front and rear ends of the portion, which actual portion length in this case corresponds to the target portion length 20-target, wherein a tolerance range (not shown) is also stored in the controller 1* for the target portion length 20-target, which tolerance range consists of a negative tolerance value and a positive tolerance value.

However, with the correct portion length 20-target=20-actual, the slice distance 19-actual between the slices S2 and S3 S is much smaller, and between the slices S3 and S4 is much larger, than the slice distance 19-target.

Therefore, production parameters that affect the longitudinal position of the slice S3 within the portion P must be changed so that afterwards all slices again have the same target slice distance 19-target.

Figure 4:
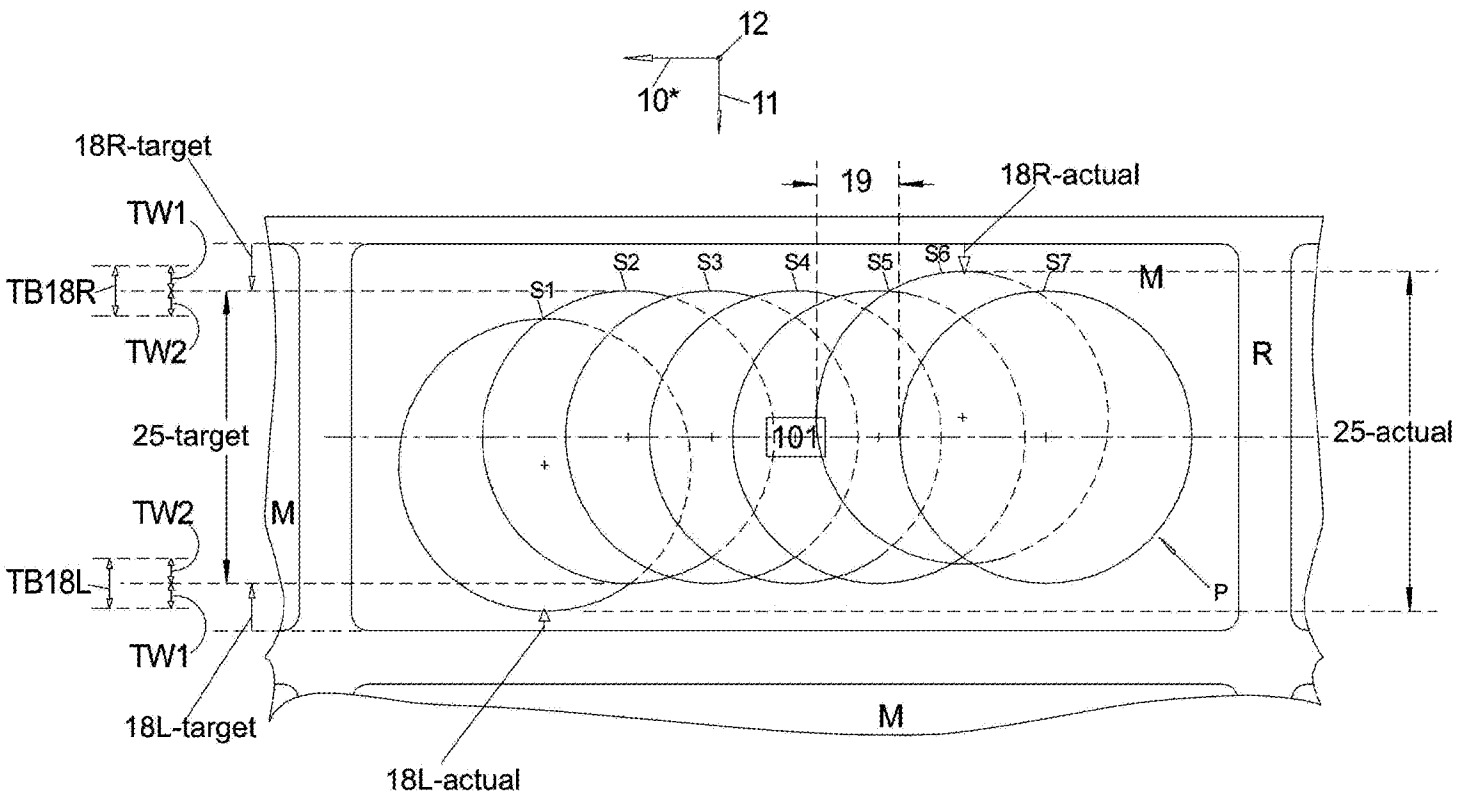
FIG. 4 is the same view as in FIG. 2B, but with a transverse offset of individual slices within the portion.

FIG. 4 shows an actual arrangement with problems with the transverse position of individual slices S1, S6 of portion P, one of which is too far to the left and the other too far to the right when viewed in the direction of travel 10*.

This position, i.e., the left and the right actual transverse distances 18L-actual, 18R-actual of these laterally most protruding slices and thus of the entire portion, is also determined by the sensor 101 and compared with the left and right target transverse distances 18L-target, 18R-target stored in the target arrangement values. Because the actual transverse distances are each outside the permissible tolerance range, the controller 1* automatically changes the production parameters relating to the transverse position of these two slices S1, S6 so that they lie correctly in the trough M for subsequent portions in the transverse direction 11, i.e., with a target transverse distance 18R-target in each case.

Figure 5:
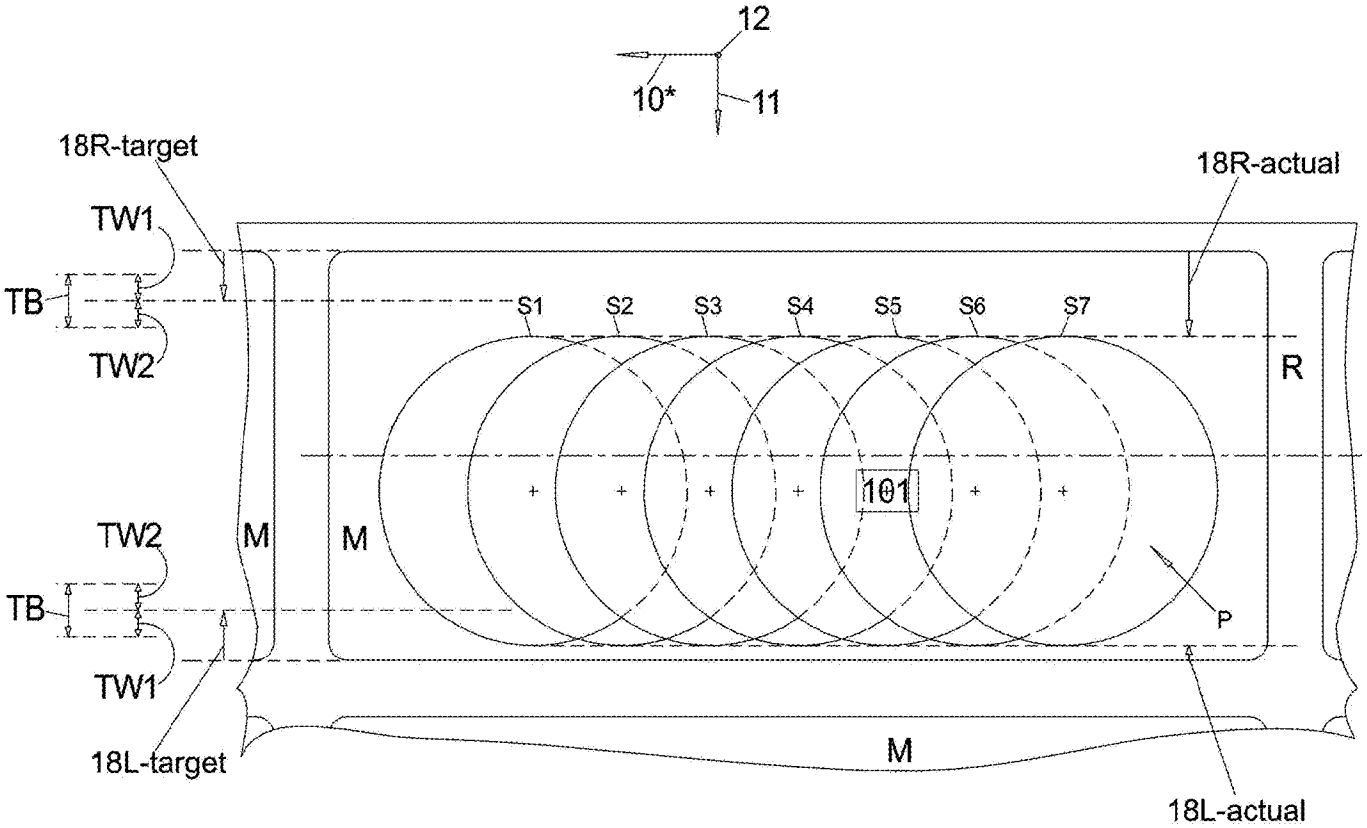
FIG. 5 is the same view as in FIG. 2B, but the entire portion has a transverse offset in the trough.

In contrast, FIG. 5 shows a deviation in which all the slices S of the portion P lie in a row in the direction of travel 10* without relative transverse deviation from one another, but the entire portion P is too close to the left edge R of the trough in the direction of flow 10*, i.e., 18L-actual is too small and is also outside the tolerance range TB18L around the 18L-target, which results in an unattractive appearance of the portion P.

Here, all production parameters that influence the transverse position of all the slices S of the portion P must be automatically adjusted so that this defect is eliminated in subsequent portions and thus a visually appealing portion P is achieved in the package.

Figure 6:
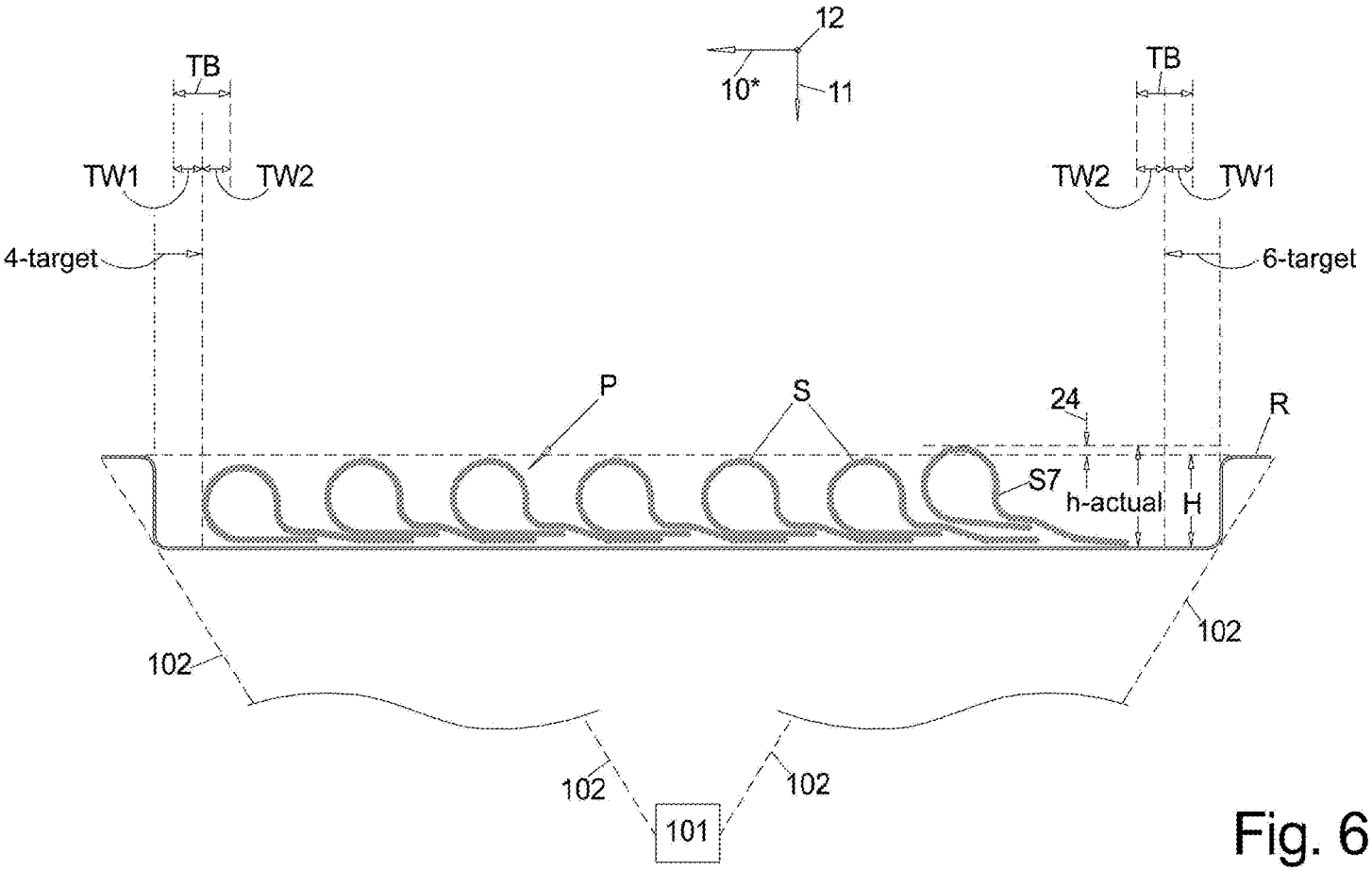
FIG. 6 is the same view as in FIG. 1B, but with a portion of folded slices in the trough.

FIG. 6 shows an actual arrangement in which the portion P extends beyond the free inner height H of the trough and thus beyond the height level of the edge R around the trough.

This can result in bulging when the sealing film (not shown) is applied, which is not visually appealing and can also result in creasing and thus leakage of the sealing film at the edge R of the trough.

A portion that is too high occurs, for example, when the portion is a shingled portion consisting of folded slices S that are folded about a folding axis running parallel to their main plane, usually by means of what is known as a folding rod, between separation and landing on the portioning belt and thus form an approximately drop-shaped contour in this side view of FIG. 6. If this drop-shaped contour has a height h-actual that is greater than the free inner height H of the trough M, said drop-shaped contour protrudes too far upward, as indicated in the case of the slice S7.

There is usually no tolerance parameter stored for this arrangement parameter in the form of the height h-actual of the portion, because a portion that is too low and folded is usually optically acceptable, but a portion that rises too high above the height level of the edge R is not acceptable.

FIG. 2C shows a vertical section in the transverse direction 11 through the troughs M, which in this case are three adjacent troughs M already filled with portions P in a trough belt 202 downstream of the inserter 21, viewed against the direction of travel 10*, so that the next format to be inserted, which is already arranged on the inserter 21, can also be seen in this case in the transverse direction 11 of three adjacent portions P, sectioned along the line IIC-IIC in FIG. 2A.

In this case, two different scanning methods using radar beams 102 are shown side by side:

The track SP1 shown in the left third of FIG. 2C is scanned by a radar sensor 101.1, which contains both a transmitter and a receiver for radar beams in the sensor and wherein the sensor 101.1 is located below and, when viewed from above, under the left portion P in the left trough M.

The radar sensor 101.1 emits its radar beams 102.1 in an upwardly widening cone against the underside of the left trough M and only this trough M, emits radiation therethrough and penetrates at least into the portion P located on the bottom of the trough, in particular also transirradiates this.

The radar beams are partially reflected by the slices S in the trough, such that the position of the portion P, in particular of the individual slices S of the portion, in the trough M can be detected from the reflected radar beams 102.1 arriving at the sensor 101.1 according to the time of flight principle and with knowledge of the position and emission direction as well as the reception direction of the radar beams, in this case for example the incorrect transverse projection of individual slices within the left portion P.

The advantage of this solution is that the trough belt 202 does not necessarily have to be made of a transparent material, but only of a material that is permeable to radar beams.

In the right part of FIG. 2C, alternatively (both solutions will probably not be used at the same time at an insertion point 201), a sensor 101.2, which in turn contains both a transmitter and a receiver, is arranged in a vertical position below the trough belt 202, but so far out in the transverse direction 11 that the emitted and reflected radar beams can be directed past the trough belt 202 to a deflection element 103 for the radar beams 102.2, which, as seen from above, is located laterally outside but at a vertical position above the trough belt 202 and irradiates the portions P in the trough belt 202 from the side obliquely above.

This is because in this solution, preferably, not only the portion P located on the corresponding side on the outermost track SP3 in the trough M is irradiated, but also a plurality of troughs M located next to one another and portions P located therein, preferably at least up to the center of the entire trough belt 202 or even across the entire width of the trough belt 202.

Here too, the radar beams 102.2 preferably penetrate at least partially into these portions P or even completely therethrough, so that the position of the portions in the trough can be detected by the sensor 101.2.

In this case, a radar shield 104 can be arranged below the trough belt 202 so that the radar beams do not reach the space below the trough belt 202.

The rays reflected by the portions P in the cavities M return to the sensor 101.2 in the opposite direction, i.e., via the deflection element 103, where they are evaluated and reflect the position of the slices S and/or portions P in the troughs M.

The advantage of this solution is that, in particular if the deflection element 103 for the radar beams is arranged only on the non-operator side AB, the operator standing on the operator side B can bend over the ejection point 201 and observe it without negatively affecting the beam path of the sensor 101.2.

A further advantage is that the radar beams 102.2 should at least partially penetrate the portions P, but do not necessarily have to penetrate the trough belt 202 itself in order to detect the position of the portions P within the still visible upper contour of the troughs M and the entire trough belt 202.

This also makes it possible to arrange a shield 104 for radar beams below the trough belt 202, as indicated in the right half of the figure.

Figure 2D:
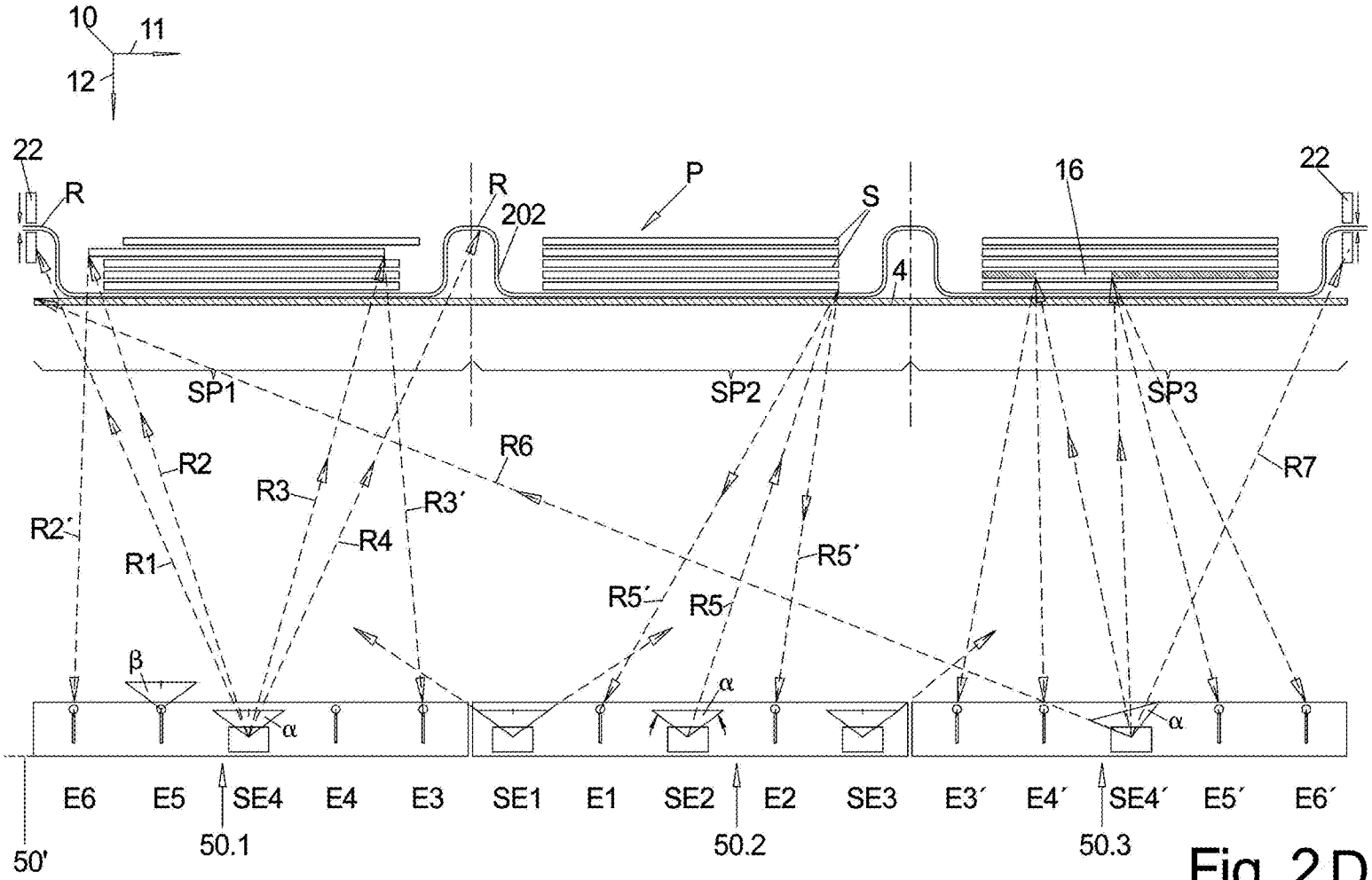
FIG. 2D shows a vertical cross section through an already filled multi-track trough belt, with scanning by individual scanners from below, each of which has a plurality of transmitters and/or a plurality of receivers.

FIG. 2D shows portions P in the trough belt 202, in which the position of the portions P, optionally also of the individual slices S within the portions P, is determined by means of scanners 50.1, 50.2, each of which has at least one transmitter SE and/or at least one receiver E for electromagnetic beams, here in particular radar beams, wherein the transmitters and/or receivers are spaced apart from one another in the first transverse direction 11, the width direction of the packaging machine, preferably along a distance line 50' running in the transverse direction.

Preferably, one of the (usually approximately bar-shaped) scanners 50.1, 50.2 has a length in this direction 11 that corresponds to the width of a track SP1, i.e., a trough M including its lateral edges.

The transmitters and/or receivers have a conical radiation characteristic at least in this transverse direction 11, preferably also a conical radiation characteristic in the direction of travel 10.

The peripheral contour is determined by, for example, one of the many radar beams R5 emitted within the radiation cone with the cone angle $\alpha$ of the transmitter, e.g. SE2, hitting such a point on a slice S and thus a portion P that it is at least partially reflected there and the reflected beam R5' is received by the receivers E1 and E2 so that the reflection point on the slice S can be determined based on the time of flight of the beam and the knowledge of the direction of incidence at the receiver E1 or E2 and the knowledge of the distance and orientation of the transmitters and receivers to the trough belt 202 and thus the portion P to be scanned.

A beam (not shown) emitted at a different beam angle by the same transmitter SE2 and during the same scan can be received by the receiver E3 or E4, which may well belong to a different scanner than the emitting transmitter, from which other reflection points on the portion P are determined.

The reflection points and thus the contour of the portions or slice or trough to be determined can be determined in different ways:

The first method consists in the fact that, due to the multitude of radiation paths from different transmitters and/or to different receivers, the reflection point can be determined taking into account the time of flight in each case and knowing the position of the transmitters and receivers relative to the trough belt.

The other method consists in using transmitters that are designed such that the specific emission direction of the emitted beam is known, or in using receivers that are designed such that the specific reception direction of the received beam is known. A single radar beam picked up by the receiver is then sufficient to determine the reflection point based on the time of flight and the knowledge of the emitting transmitter of the beam.

As is known for radar scanning, it is possible to determine the entire circumference of a slice or portion or trough shown in FIG. 2D, i.e., the circumference of a slice S or the circumference of only the entire portion P, and also the circumference of the trough M in which it is located.

Typically, at least one portion P, and often all portions P adjacent to one another in the transverse direction 11 together, are scanned in a single scan, namely when the trough belt 202 is at a standstill, for which the scanning region of the scanners 50 must be large enough.

If the portions and the scanner 50 are moved relative to each other in the direction of travel 10 between individual scans of the same portion P or a transverse row of portions P, the time offset between the individual scans and the resulting relative movement must be taken into account mathematically.

The scanner 50.1 arranged in FIG. 2D under the portion P on the track SP1 has an extension in the transverse direction 11 that corresponds to the width of this track, wherein the scanner 50.1 is constructed in such a way that it also only scans this track in the width direction.

For this purpose, the scanner has only one transmitter SE4, preferably arranged symmetrically in the middle of the extension direction 11, and receivers E3 to E6 on either side thereof.

In particular, the transmitter SE4 has an emission cone such that (see the radar beams R1 and R4) at least the outer edges R of the track SP1 and in particular the portion P arranged thereon in the trough and, with appropriate radiation, also the position of the slices S can be scanned. In particular, the SE4 transmitter has an emission cone arranged symmetrically to the plane spanned by the directions 10 and 12.

Thus, a radar beam R2 coming from the single transmitter SE4 can be reflected at the leftmost point of the overhanging edge of the second slice S from above and impinges on the receiver E6 as reflected beam R2'.

In the same way, a radar beam R3/R3' coming from the same transmitter SE4 can arrive at the receiver E3.

In this way, the portion P and its slices S and, if applicable, the trough M in which it lies can be scanned on the track SP1.

A scanner 50.3 arranged above the opposite outer track SP3 is constructed in such a way that the sequence of transmitters and receivers is a mirror image of the center track SP2 or another center track in the left outer scanner 50.1.

In addition, however, it is evident in the case of the scanner 50.3 that the emission cone of the transmitter SE4' there is not arranged symmetrically with respect to the plane mentioned for the transmitter SE4, but is tilted with respect to the direction of travel 10 in such a way that the beams emitted thereby scan not only the portions of the track SP3 above, but all the portions in the transverse direction 11 adjacent to one another at the same time.

Thus, the radar beam R6 emitted by the transmitter SE4' as far to the left as possible in its emission cone extends to the left edge of the trough belt 202, and the beam R7 emitted as far to the right as possible extends to the right edge of the trough belt 202.

In this way, theoretically, the entire width of the trough belt 202 could be scanned with only the scanner 50.3, but with poor results in the center and in the opposite left edge region, which is why redundant data for support and recovery is usually located under each track, in particular the leftmost track SP1 opposite the scanner 50.3 with full width scanning.

The scanner 50.2, which is arranged here under the or one of the center tracks SP2 in the case of the three tracks, is also constructed in such a way with regard to the cone angle and direction of the emission cones as well as the incidence cones that the entire width of the trough belt 202 can be scanned therewith.

In this case, however, the sequence of transmitters SE and receivers E is different: three transmitters SE1, SE2, SE3, and in each case one receiver E1 and E2 therebetween, are distributed symmetrically over the extension of the scanner 50.2 in the transverse direction 11.

Solutions with a plurality of transmitters but only a single receiver in a scanner 50 are also possible.

These different solutions are generally not used at one and the same scanning point for the trough belt 202, but rather

- either a scanner under each of the tracks, which is constructed in particular like the scanner 50.1,
- or a scanner under the outer tracks SP1, SP3, which is constructed in particular like the scanner 50.3,
- then preferably under the one or more tracks SP2 therebetween scanners that can at least scan these tracks in between or can also scan the entire width of the trough belt, in particular scanners that are constructed like the scanner 50.2.

In this way, contours within, for example, a slice, for example a cavity or a foreign body, can also be scanned, provided that the foreign body has other physical parameters with regard to reflection, absorption and diffraction for the electromagnetic radiation used, in this case the radar radiation, even if it is made of a material such as metal that is impenetrable to the electromagnetic radiation.

In FIG. 2D it can also be seen that the individual receivers E1 to E6 have an incidence cone having a corresponding opening angle β, so that each individual receiver E1 to E6 can "see" the entire width of at least one track of the feed belt 4, and can preferably "see" the entire width of the feed belt 4. In particular, this ensures that any reflection point of interest, provided it is at least within the width of this track, is detected by each of the receivers E1 to E6.

Likewise, each transmitter SE has an emission cone having an opening angle α, so that each individual transmitter SE can irradiate the entire width of at least one track of the trough belt 202, preferably the entire width of the trough belt 202.

Preferably, the receiving regions of the individual, in particular adjacent, receivers E and/or the emission regions of the individual, in particular adjacent, transmitters SE, even if they are distributed over a plurality of scanners 50.1, 50.2, should overlap one another in the direction of a scan line 50' running in the transverse direction 11.

FIG. 2D also shows a clamping chain 22 at both edges of the trough belt, each holding and transporting one edge of the trough belt 202, so that the alternatively shown support for the trough belt 202 does not necessarily have to be present underneath the trough belt 202, which would otherwise also have to be permeable to the radar beams 102 like the trough belt itself.

As one skilled in the art would understand, the controller 1*, the scanners 50, 50.1, 50.2, 50.3, sensors 101, 101.1, 1012, as well an any other unit, machine, apparatus, element, sensor, device, component, system, subsystem, arrangement, or the like described herein may individually, collectively, or in any combination comprise appropriate circuitry, such as one or more appropriately programmed processors (e.g. one or more microprocessors including central processing units (CPU)) and associated memory, which may include stored operating system software and/or application software executable by the processor(s) for controlling operation thereof and/or for performing the particular algorithms represented by the various functions and/or operations described herein, including interaction and/or cooperation between any such controller, scanner, sensor, unit, machine, apparatus, element, device, component, system, subsystem, arrangement, or the like. One or more of such processors, as well as other circuitry and/or hardware, may be included in a single ASIC (Application-Specific Integrated Circuitry), or several processors and various circuitry and/or hardware may be distributed among several separate components, whether individually packaged or assembled into a SoC (System-on-a-Chip).

LIST OF REFERENCE SIGNS

1 Slicing machine, slicer
1* Controller
2 Base frame
3 Blade
3 Axis of rotation
3" Blade plane, cutting plane
3*a*** Cutting edge
4 Initial distance
5 Cutting goggles
6*a-d*** Final distance
7 Cutting unit
8 Upper product guide, upper guide belt
9 Lower product guide, lower guide belt
10 Feed direction, longitudinal direction, axial direction
10* Direction of travel through machine
11 1st Transverse direction (width slicer)
12 2nd Transverse direction (height-direction of log)
13 Portion production unit
14 Portion delivery unit
15 Packaging delivery unit
16 Cavity
17 Discharge unit
17*a, b, c*** Portioning belt, discharge conveyor
18 Transverse distance
19 Slice spacing
20 Portion length
21 Inserter
22 Clamping chain
50.1, 50.2 Scanner
50' Scan line
100 Packaging machine
101 Sensor, radar sensor
102 Radar beams
103 Deflection element
104 Radar shielding
200 Inserter
201 Ejection point, insertion point
202 Trough belt
500 Packaging apparatus
h-actual Actual height
H Trough height
M Trough, packaging trough
P Portion
R Edge
S Slice
V Packaging element

What is claimed is:

1. A method for automatically achieving a predetermined target portion arrangement of a portion of one or more slices deposited on a packaging element, the method comprising:

automatically determining, from below the packaging element and without contact, an actual portion arrangement of the portion in a deposited state of the portion relative to a base frame or to the packaging element;

automatically comparing the actual portion arrangement to a predetermined target portion arrangement;

wherein, if the actual portion arrangement deviates from the target portion arrangement by more than a predetermined tolerance range, automatically changing at least one production parameter of an upstream portion production unit and/or portion delivery unit and/or a packaging delivery unit so that an actual portion arrangement of subsequent portions lies within all tolerance ranges around target portion arrangement values of the target portion arrangement;

wherein the actual portion arrangement of the portion is determined through the packaging element.

2. The method according to claim 1, wherein the actual portion arrangement of the portion is determined by irradiating or transirradiating the portion with electromagnetic radiation.

3. The method according to claim 2, wherein the actual portion arrangement of the portion is determined by use of electromagnetic radiation having a wavelength in a range not visible to the human eye.

4. The method according to claim 1, wherein the actual portion arrangement of the portion is determined by transirradiating the packaging element with electromagnetic radiation.

5. The method according to claim 4, wherein an actual arrangement of the packaging element relative to the base frame is determined.

6. The method according to claim 1, wherein the actual arrangement of the portion is determined by emitting electromagnetic radiation onto the portion from above the portion.

7. The method according to claim 6, wherein the actual arrangement of the portion is determined by deflecting the electromagnetic radiation from a radiation source arranged below the packaging element, by at least one deflection element arranged laterally above the portion, onto an upper side of the portion.

8. The method according to claim 1, wherein the actual portion arrangement of the portion is determined by irradiating or transirradiating the portion with electromagnetic radiation having a wavelength between 20 GHz and 6 THz.

9. The method according to claim 8, wherein the electromagnetic radiation has a wavelength in the radar range between 20 and 40 GHz.

10. The method according to claim 1, wherein automatically changing the at least one production parameter only takes place when a detected deviation has been identified as a repetitive error.

11. The method according to claim 1, wherein automatically determining the actual portion arrangement of the portion is performed using a scanner having at least one transmitter and at least one receiver as a sensor.

12. A packaging apparatus comprising:

a packaging machine for packaging a portion of one or more slices deposited on a packaging element;

a portion delivery unit configured to deliver the portion to the packaging machine;

a portion production unit configured to produce the portion;

a packaging delivery unit configured to deliver the packaging element to the packaging machine;

a sensor for determining a portion arrangement of the portion relative to a base frame or to the packaging element by use of electromagnetic radiation; and a controller that is connected to the sensor and that is able to control production parameters of an upstream portion production unit and/or portion delivery unit and/or the packaging delivery unit depending on data supplied by the sensor;

wherein the sensor is arranged either below the packaging element or laterally adjacent thereto, but at a vertical position above or below a movement path of the packaging element;

wherein the sensor is configured to determine the actual portion arrangement of the portion through the packaging element.

13. The packaging apparatus according to claim 12, wherein the sensor comprises a transmitter and a receiver for electromagnetic radiation;

and/or the sensor operates in a wavelength range between 20 GHz and 6 THz.

14. The packaging apparatus according to claim 12, wherein the sensor is part of a scanner that is designed such that it is capable of working with microwave radiation, or working with tera radiation at a frequency of 0.3 THz-6 THz.

15. The packaging apparatus according to claim 12, wherein the sensor is part of a scanner that is designed such that it is capable of operating with such a power that the electromagnetic radiation is suitable for determining at least a peripheral contour of the portion.

16. The packaging apparatus according to claim 12, wherein the sensor is part of a scanner, and a scanning direction of the scanner is arranged transverse to a plane spanned in a direction of travel of the packaging apparatus and a first transverse direction.

17. The packaging apparatus according to claim 12, wherein the sensor is part of a scanner, and wherein the scanner has at least one receiver and at least one transmitter, and positions of the at least one receiver and/or the at least one transmitter are known, and/or the scanner has a plurality of receivers and/or a plurality of transmitters, and receiving regions of adjacent receivers overlap each other on or in the portion.

18. The packaging apparatus according to claim 17, wherein in each case an emission direction of the at least one transmitter or a reception direction of the at least one receiver is known, and/or an emission power of the transmitters is known.

19. The packaging apparatus according to claim 17, wherein the scanner comprises the plurality of receivers, and the receivers of the plurality of receivers are, with respect to a reference plane, all approximately equally spaced therefrom, and/or are arranged one behind the other in a direction of a scan line.

* * * * *